United States Patent [19]

Piscitelli et al.

[11] 4,373,773

[45] Feb. 15, 1983

[54] SOCKET TYPE CONTACT ASSEMBLY

[75] Inventors: R. Amelia Piscitelli; Valentine J. Hemmer, both of Sidney; Charles P. Fischer; Eric F. Shepler, both of Bainbridge, all of N.Y.

[73] Assignee: The Bendix Corporation, Southfield, Mich.

[21] Appl. No.: 228,495

[22] Filed: Jan. 26, 1981

[51] Int. Cl.[3] ..... H01R 4/10

[52] U.S. Cl. ..... 339/262 R; 339/258 R; 339/276 T

[58] Field of Search ..... 339/258 R, 258 P, 262, 339/276 R, 276 T, 223 R

[56] References Cited

U.S. PATENT DOCUMENTS 4,072,394 2/1978 Waldron et al. ..... 339/276 T
4,120,556 10/1978 Waldron et al. ..... 339/276 T
4,133,599 1/1979 Powell ..... 339/258 R
4,136,923 1/1979 Spaulding ..... 339/258 R

FOREIGN PATENT DOCUMENTS 1022113 3/1966 United Kingdom ..... 339/258 R

*Primary Examiner*—John McQuade
*Assistant Examiner*—Gary F. Paumen
*Attorney, Agent, or Firm*—Raymond J. Eifler

[57] ABSTRACT

This invention is a three piece contact assembly of the type having an inner sleeve (10), a forward sleeve (20), and a rear sleeve (30), wherein the inner sleeve is characterized by a dual thickness. The forward portion of the inner sleeve 10 has a thickness (T) greater than the thickness (t) of the rear wire receiving end thereby strengthening the deflectable fingers (14) at the mating end of the inner sleeve (10).

2 Claims, 7 Drawing Figures

SOCKET TYPE CONTACT ASSEMBLY

This invention relates to electrical connectors and more particularly to a three piece socket type electrical contact for the connector.

Electrical connectors generally comprise a shell or housing; a plurality of electrical contacts, each of which are connected to separate incoming wires; and a dielectric insert assembly for fixedly or removably mounting the electrical contacts in the connector shell. In an attempt to reduce the size and cost of electrical connectors, the contacts which formerly were machined from a single piece are being replaced with less expensive electrical contacts stamped and formed from a sheet of metal and protected by one or more sleeves. Examples of such stamped and formed contacts may be found in U.S. Pat. Nos. 4,072,394 entitled "Electrical Contact Assembly" issued Feb. 7, 1978; 4,120,556 entitled "Electrical Contact Assembly" issued Oct. 17, 1978; and 4,136,923 entitled "Unitary Hooded Electrical Contact" issued Jan. 30, 1979. Presently, three piece contacts are made by stamping an inner sleeve from a sheet of beryllium copper metal, forming it into a desired shape having a plurality of radially deflectable fingers, heat treating it to obtain a desired resiliency for the fingers, and then placing stainless steel sleeves over the front and rear portions of the inner sleeve to respectively protect the fingers and strengthen the rear wire receiving portion. When a three piece contact of the type shown in the 4,072,394 patent is used in a subminiature connector, the contacts are stamped from beryllium copper stock 0.1 millimeters thick and formed into contacts 1.25 centimeters long with a diameter of about 0.12 centimeters. When such a connector is subjected to heat aging, a force greater than 17 grams will deflect and bend the fragile fingers so that they may not return completely to their original undeflected position. To strengthen the fingers, axially extending ridges were placed along the longitudinal area of the fingers but this only provided marginal success. Accordingly many of these three piece contacts met all the requirements of U.S. Military Specification C-39029 but at the minimum of the specification limits.

DISCLOSURE OF THE INVENTION

This invention is a three piece contact assembly wherein the resiliently deflectable fingers of the inner sleeve are stronger than previous fingers.

The invention is a three piece contact assembly characterized by an inner sleeve stamped and formed from a single piece of beryllium copper metal that was comprised of a first thickness that extended the entire length of the rear wire receiving portion and a second thickness greater than the first thickness that extended the entire length of the mating portion of the inner sleeve that included the fingers.

Accordingly an advantage of this invention is the provision of a three piece contact with stronger mating fingers in the forward portion of the contact assembly.

DETAILED DESCRIPTION OF THE INVENTION

Figure 1:
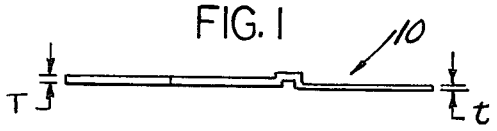
FIGS. 1 through 5 illustrates how the inner sleeve of the contact assembly is formed.

Referring now to the drawings, FIG. 1 illustrates a side view of a stamping used to make the inner sleeve of a contact. One end of the stamping has a thickness t while the other end has a thickness T which is thicker than the thickness of the material at the other end. Preferably, a stamping of about 0.12 millimeters thick is reduced at one end portion (real wire receiving portion when formed) to about 0.1 millimeters thick. The dual thickness stock may be rolled or milled to the desired thicknesses.

Figure 2:
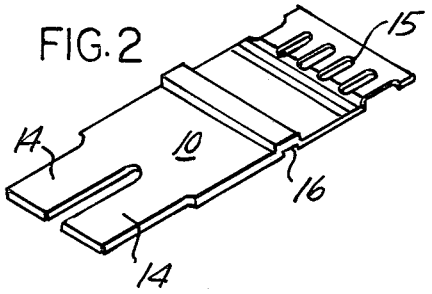

FIG. 2 illustrates the configuration of the stamping which includes a plurality of fingers 14 at one end, a plurality of elongated slots 15 at the other end and a center portion that includes a groove 16.

Figure 3:
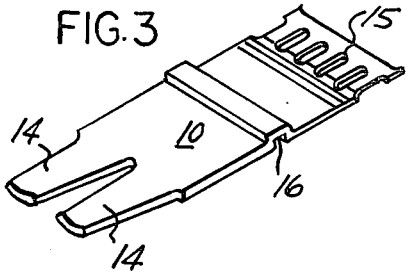
Figure 4:
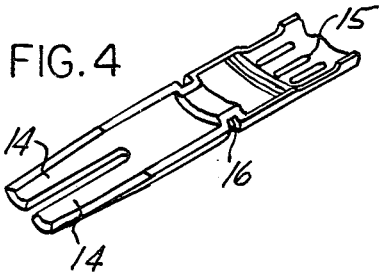

FIGS. 3 and 4 show the inner sleeve in its progressively and partially formed state.

Figure 5:
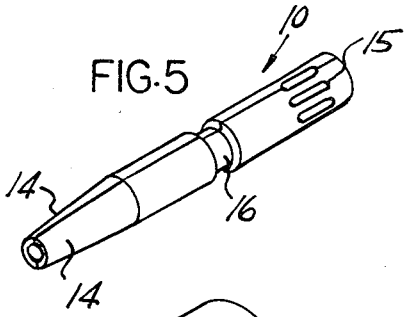

FIG. 5 shows the completely formed inner sleeve 10.

Figure 6:
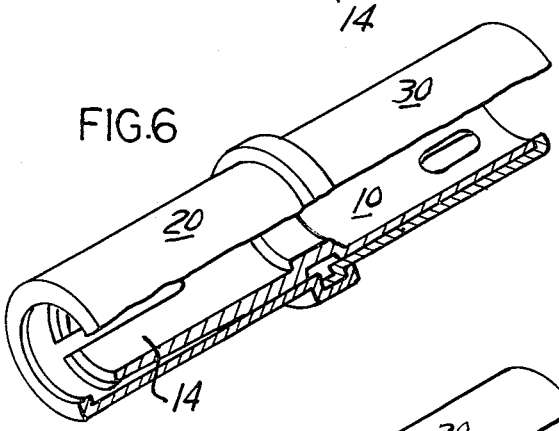
FIG. 6 illustrates a three piece contact assembly embodying the principles of this invention.

FIG. 6 illustrates a three piece contact assembly that includes an inner sleeve 10, a forward sleeve 20 and rear sleeve 30. It is the function of the forward sleeve 20 to protect the resiliently deflectable fingers 14 of the inner sleeve 10 from damage. The rear sleeve 30 which is comprised generally of a stainless steel is used to facilitate a good crimp when a wire (not shown) is inserted into the rear wire receiving end of the contact assembly.

Figure 7:
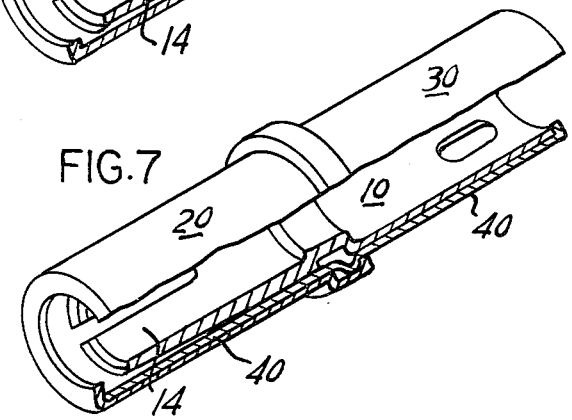
FIG. 7 illustrates an alternate embodiment of a three piece contact incorporating the principles of this invention.

FIG. 7 is an illustration of another type of three piece of contact assembly which includes the inner sleeve 10, an intermediate sleeve 40, extending the entire length of the inner sleeve, and a forward sleeve 20 which protects the fingers 14 and the forward mating end of the inner sleeve 10. When the socket type contact assembly shown in FIG. 7 is mated with a pin type contact (not shown) the greater thickness of the forward fingers 14 will increase the engagement forces on the pin contact and help in maintaining that force over the life time of the contact assembly even when subjected to heating and cooling repeatedly.

While a preferred embodiment of the invention has been disclosed it will be apparent to those skilled in the art that changes may be made to the invention as set forth in the apended claims and, in some instances, certain features of the invention may be used to advantage without corresponding use of other features. Accordingly, it is intended that the illustrative and descriptive materials herein be used to illustrate the principles of the invention and not to limit the scope thereof.

Having described the invention what is claimed is:

1. In combination with a three piece contact of the type having: a one piece inner sleeve stamped and formed from a single sheet of metal, said sleeve having a forward mating portion that includes a plurality of deflectable fingers, a rear wire receiving portion and a middle portion; a rear sleeve telescopically mounted to the rear portion of the inner sleeve; and a forward sleeve telescopically mounted to the forward portion of said inner sleeve, the improvement wherein the inner sleeve includes:

a first uniform thickness extending the entire length of the rear wire receiving portion of said inner sleeve and a second uniform thickness greater than the first thickness, said second thickness extending the entire length of the mating portion of said inner sleeve, whereby the forward mating portion of said inner sleeve is strengthened.

2. In combination with a three piece contact of the type having a one piece inner sleeve stamped and formed from a single sheet of metal, said sleeve having a front mating portion that includes a plurality of deflectable fingers, a rear wire receiving portion; an intermediate sleeve telescopically mounted over said inner sleeve; and an outer sleeve telescopically mounted on the front portion of said intermediate sleeve, the improvement wherein the inner sleeve includes:

a first uniform thickness extending the entire length of the rear wire receiving portion of said inner sleeve and a second uniform thickness greater than the first thickness, said second thickness extending the entire length of the forward mating portion of said inner sleeve, whereby the forward mating portion of said inner sleeve is strengthened.

* * * * *